US011749233B2

(12) United States Patent
Ingallinera

(10) Patent No.: US 11,749,233 B2
(45) Date of Patent: Sep. 5, 2023

(54) ELECTRIC BOWED STRING INSTRUMENT STRUCTURE

(71) Applicant: Giovanni Ingallinera, Ragusa (IT)

(72) Inventor: Giovanni Ingallinera, Ragusa (IT)

( * ) Notice: Subject to any disclaimer, the term of this patent is extended or adjusted under 35 U.S.C. 154(b) by 87 days.

(21) Appl. No.: 17/612,266

(22) PCT Filed: May 27, 2019

(86) PCT No.: PCT/IB2019/054387
§ 371 (c)(1),
(2) Date: Nov. 18, 2021

(87) PCT Pub. No.: WO2020/240250
PCT Pub. Date: Dec. 3, 2020

(65) Prior Publication Data

US 2022/0215816 A1 Jul. 7, 2022

(51) Int. Cl.
*G10D 1/02* (2006.01)
*G10H 1/32* (2006.01)
*G10H 3/18* (2006.01)

(52) U.S. Cl.
CPC ..... *G10D 1/02* (2013.01); *G10H 1/32* (2013.01); *G10H 3/185* (2013.01); *G10H 2220/525* (2013.01); *G10H 2230/075* (2013.01)

(58) Field of Classification Search
CPC ..... G10D 1/02; G10H 1/32; G10H 1/185
See application file for complete search history.

(56) References Cited

U.S. PATENT DOCUMENTS 1,861,717 A * 6/1932 Pfeil ..... G10H 3/185 984/103
2,310,199 A * 2/1943 Beauchamp ..... G10H 3/18 84/723
2,539,297 A * 1/1951 Gomez ..... G10D 1/02 84/DIG. 24
4,411,186 A * 10/1983 Faivre ..... G10D 3/02 984/107
4,765,219 A * 8/1988 Alm ..... G10H 3/181 335/297

(Continued)

FOREIGN PATENT DOCUMENTS

EP 0911800 A1 * 4/1999 ..... G10D 3/00
EP 2079075 A2 * 7/2009 ..... G10D 3/12

(Continued)

*Primary Examiner* — Robert W Horn
(74) *Attorney, Agent, or Firm* — Mark M. Friedman

(57) ABSTRACT

An electric bowed string instrument structure comprises a longitudinally elongated frame (2) having a central recess (8) provided with a bottom (9), a fingerboard (5) anchored to the neck (4), a tailpiece (7) anchored to the rear end portion (6) of the frame (2), a plurality of strings (13) extending between the fingerboard (5) and the tailpiece (7), a bridge (12) adapted to support the strings (13), a pick-up (14) adapted to intercept the vibrations produced by the strings (13) and to be connected to sound amplifying means, a soundboard (11) interlocked in the recess (8) in a transversely offset position with respect to the bottom (9), the soundboard (11) being convex with a convexity facing towards the strings (11), the pick-up (14) being arranged below the soundboard (11).

11 Claims, 4 Drawing Sheets

(56) References Cited

U.S. PATENT DOCUMENTS 5,123,326 A * 6/1992 Clevinger ..... G10D 3/02 84/723
5,191,159 A * 3/1993 Jordan ..... G10D 1/02 84/274
5,945,622 A * 8/1999 Yamada ..... G10H 3/185 84/731
5,990,410 A * 11/1999 Johnson ..... G10H 3/185 84/731
6,255,565 B1 * 7/2001 Tamura ..... G10D 1/085 84/290
6,791,023 B2 * 9/2004 Nakaya ..... G10H 3/186 84/736
7,084,337 B1 * 8/2006 Schroeder ..... G10G 5/005 84/274
7,339,106 B2 * 3/2008 Tamura ..... G10H 3/146 84/723
7,592,529 B2 * 9/2009 Tamura ..... G10H 3/185 84/309
10,204,602 B2 * 2/2019 Quercetani ..... G10D 3/02
2005/0098018 A1 * 5/2005 Tamura ..... G10D 1/02 84/302
2007/0084335 A1 * 4/2007 Silzel ..... G10H 3/146 84/723
2009/0173208 A1 * 7/2009 Tamura ..... G10D 3/13 84/302
2021/0304719 A1 * 9/2021 Perry ..... G10H 3/182
2022/0215816 A1 * 7/2022 Ingallinera ..... G10H 3/183

FOREIGN PATENT DOCUMENTS

GB 2038069 A * 7/1980 ..... G10D 1/02
GB 2265247 A * 9/1993 ..... G10D 1/02
GB 2319652 A * 5/1998 ..... G10D 1/02

* cited by examiner

ELECTRIC BOWED STRING INSTRUMENT STRUCTURE

TECHNICAL FIELD

The present invention finds application in the technical field of musical instruments and particularly relates to an electric bowed string instrument structure.

STATE OF THE ART

As known, in bowed string instruments such as violins, violas, cellos and double basses, sound is produced, without wishing to go too far in theory, by the vibration of the harmonic case which is obtained following the mechanical stress transmitted to the strings by means of a bow.

The traditional instruments, although they can be made efficient by the luthier in order to obtain the maximization of the vibrational capacities and consequently the maximization of the sound production, still have a limited sound volume, as only a part of the entering mechanical energy is transformed into sound energy. For this reason, in some contexts it is necessary to provide means which amplify the sound.

Generally, magnetic/piezoelectric microphones or transducers adapted for picking up the sound of the instrument to send it to an electric amplifier are used for this aim. However, this system is not used very much in live performances since the enormous sound pressure produced by the external amplification system induces "re-entry" resonances in the instrument itself, generating the undesired "Larsen effect" or acoustic feedback.

This effect is generated by the re-entry into the instrument of the sound emitted by the amplifier and the subsequent re-transmission of the re-entry sound to the amplifier, generating a continuous loop that produces annoying sounds.

The onset of the feedback is closely linked to the structure of the instrument, in particular to the air contained therewithin and to the lightness of the soundboard and of the bottom.

Consequently, to reduce the feedback it is possible to provide a heavy and full structure and in which the task of amplifying the sound is delegated exclusively to the electronics, thus obtaining the electric violin.

In general, an electric violin is formed by a block of solid and heavy wood on which the handle is grafted on one side while the tailpiece is arranged on the other.

The electric violin does not have a soundboard and a bottom and is therefore also devoid of cavities, but it is characterized by a full structure adapted to produce vibrations.

However, these vibrations have different features from those of an acoustic violin and for this reason more or less complex electronic modules are used that have the task of modifying the sound so as to make it as close to that of an acoustic violin. However, the known solutions are not absolutely satisfactory in terms of results as the sound produced by the electric violins differs significantly from that of the acoustic violins.

As matter of fact, acoustic violins are characterized by a "soft" and relatively "long" attack curve, which represents the way in which the volume goes from zero to its maximum value, that is with a sound energy that grows slowly and gradually from the moment in which the action of the bow begins on the strings.

This feature is linked to the presence of a light structure that tends to absorb the vibrational energy of the strings to return it in the form of sound only after a sort of balance has been established between the resonances of the soundboard, bottom and air.

By contrast, the sustain, which is the property of the musical instrument to maintain the sound over time, is short and with a rapid decay as soon as the string rubbing ceases, as the light body accumulates little energy and dissipates it very quickly.

On the contrary, in electric violins there is a "sharp and short" attack because it is as the heavy structure literally "reflected" the vibrations and the energy related thereto directly to the transduction system.

By contrast, the sustain is too long and persistent compared to that of the acoustic violin due to the enormous "vibrational inertia" that springs from the heavy structure. Since it was found that attack and sustain are the two features that allow our brain to recognize a sound, it follows that the two types of instruments do not provide a homogeneous sound.

Even the use of electronic adjustments is not adequate as the final result is a synthesized sound not accepted by the violinists.

U.S. Pat. No. 5,990,410 describes an electric violin wherein the frame comprises two curved elements having opposite convexities, developed both longitudinally and transversely.

The upper curved element is provided with a slot through which the bridge passes, to rest on the concave face of the lower curved element.

The two parts are then connected on the perimeter so as to enclose a relatively small air volume and are also fixed at the ends to the frame by screws.

Furthermore, the frame has a central support which supports the central part of the lower curved element to which it is fixed by additional passing screws.

This avoids the lateral sliding of the curved elements with respect to the frame.

However, it follows that the natural vibration of the elements is inhibited that in this way cannot act as a soundboard.

The instrument also comprises a piezoelectric pick-up placed between the bridge and the lower curved element, so as to pick up mainly the vibrations coming from the bridge which will not therefore be influenced by the surrounding structure.

However, this specific pick-up position returns a spectrum very shifted on the high frequencies so that it results unpleasant. To overcome this drawback the instrument provides the use of a treble filter obtained with a rubbery body, which although attenuating the high frequencies, inevitably has a degradation effect on the signal.

The fixed position of the pick-up also does not allow the musician to pick up different sound components in order to obtain different tones.

A further drawback of this instrument is related to the impossibility of adjusting the position of the bridge, preventing the musician from changing the centering of the strings on the keyboard and the tuning fork at will.

EP0911800 discloses an electric bowed string instrument which comprises a structure operating as a sound box with a front block provided with the keyboard and a rear block provided with the tailpiece, a soundboard being placed between them and in direct contact with the bridge to receive the vibrations produced by the strings through it.

The soundboard is floating between the two blocks and kept in position only due to the compression produced by the bridge.

However, in correspondence with some notes this condition leads to the arising of acoustic defects, called beatings, due to the overlaps between the vibration frequencies of the strings and the resonance frequencies of the soundboard, with the generation of the so-called "wolf tone".

SCOPE OF THE INVENTION

The object of the present invention is to overcome the above drawbacks by providing an electric bowed string instrument structure which is characterized by high efficiency and reliability.

A particular object is to realize an electric bowed string instrument structure that allows to have an instrument with a dynamic response in terms of attack and sustain very similar to that of the analogous traditional acoustic instrument.

A particular object is to provide an electric bowed string instrument structure which allows to eliminate the disturbances produced by the overlapping of the vibration frequencies of the strings with the vibration frequencies of the soundboard.

Still another object is to provide an electric bowed string instrument structure combining excellent lightness and good resistance to the pulling and crushing action on the strings.

Still another object is to provide an electric bowed string instrument structure which does not suffer from the negative effects of the feedback.

These objects, as well as others which will become more apparent hereinafter, are achieved by an electric bowed string instrument structure which, according to claim 1, comprises a longitudinally elongated frame having a front end portion provided with a neck and a rear end portion, said frame having a central recess open laterally and upwardly and having a bottom, a keyboard anchored to said neck, a tailpiece anchored to said rear end portion, a plurality of strings extending longitudinally between said keyboard and said tailpiece, a bridge extending transversely with respect to said frame and adapted to support said strings, a pick-up adapted to be connected to sound amplification means.

The frame comprises a soundboard interlocked in said recess in a transversely offset position from said bottom, said soundboard being convex with convexity facing said strings, said pickup being arranged below said soundboard.

The structure will thus be devoid of an air volume that can resonate and generate feedback.

Moreover, the soundboard will be suitably locked in such a way as not to suffer oscillations that can lead to the generation of vibrations which may overlap the vibrations of the strings, generating acoustic disturbances.

Furthermore, the hollow structure of the frame allows for a light structure, while the presence of the soundboard offset with respect to the bottom allows to not provide for a full structures typical of electric instruments while providing for an optimal ratio between the surface exposed to the re-entry sound waves and mass, so as to have an instrument comparable to a classic instrument not only with regard to attack and sustain but also in the tone.

The terms front and back, as well as other terms suitable to indicate a position of one of the parts of the structure with respect to the others are to be considered purely indicative and have the sole purpose of improving the intelligence of the invention. Advantageous embodiments of the invention are obtained according to the dependent claims.

BRIEF DISCLOSURE OF THE DRAWINGS

Further features and advantages of the invention will become more apparent in the light of the detailed description of preferred but not exclusive embodiments of an electric bowed string instrument structure according to the invention, shown by way of non-limiting example with the aid of the attached drawing tables in which.

BEST MODES OF CARRYING OUT THE INVENTION

With reference to the attached drawings, some preferred but not exclusive embodiments of an electric bowed string instrument according to the invention are illustrated.

Figure 1:
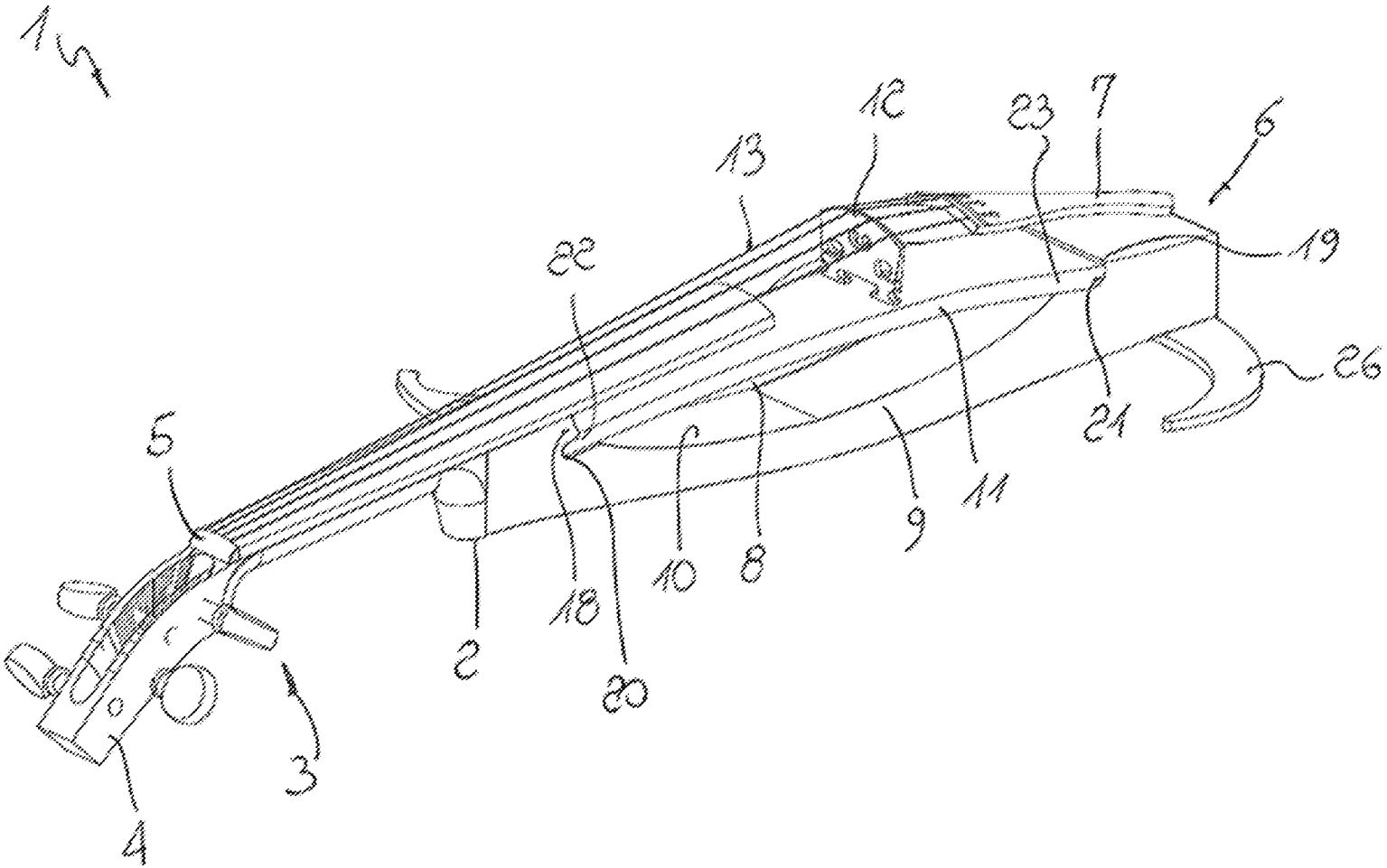
FIG. 1 is a perspective view of the structure of the invention according to a first embodiment.
Figure 2:
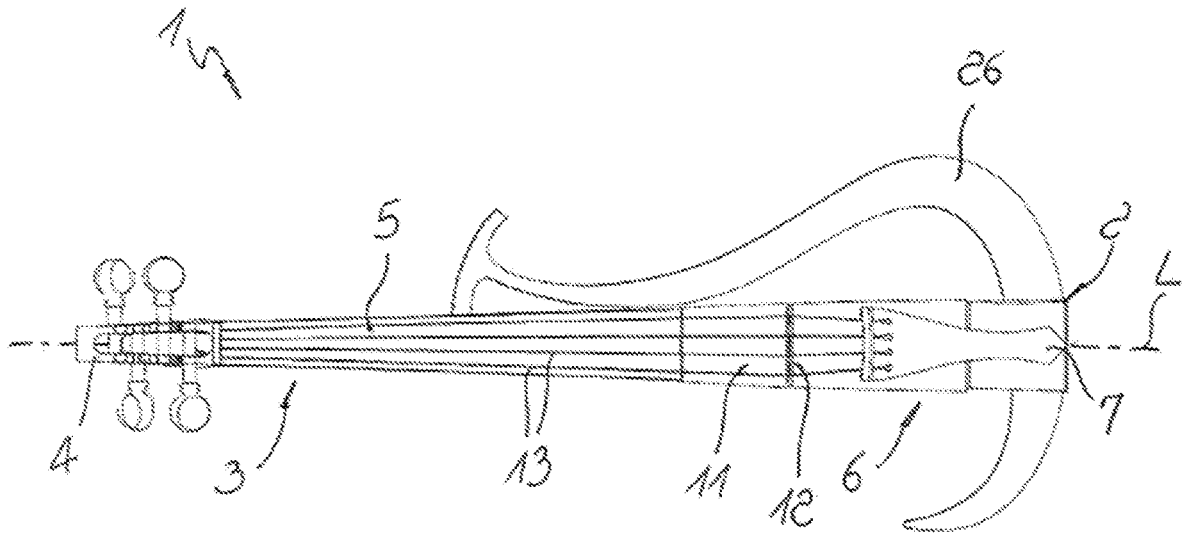
FIG. 2 is a top view of the structure of FIG. 1.

In these embodiments, the instrument structure will be designed for manufacturing a violin, in particular an electric violin, but the same innovative concepts expressed below may be used to make further bowed string instruments, such as, by way of example and not limited to, violas, cellos, double basses, archtop guitars and the like. As shown in FIG. 1, the structure, globally indicated as 1, essentially comprises a frame 2 which extends along a main longitudinal development direction L from a front end portion 3, provided with a neck 4 having a keyboard 5, to a rear end portion 6 to which the tailpiece 7 is instead anchored.

The frame 2 is also centrally shaped to define a central recess 8 open both laterally and upwardly and closed by a bottom 9, so as not to define any volume of air enclosed therein and which otherwise could enter into resonance, generating the undesired Larsen effect or feedback phenomenon.

Figure 3:
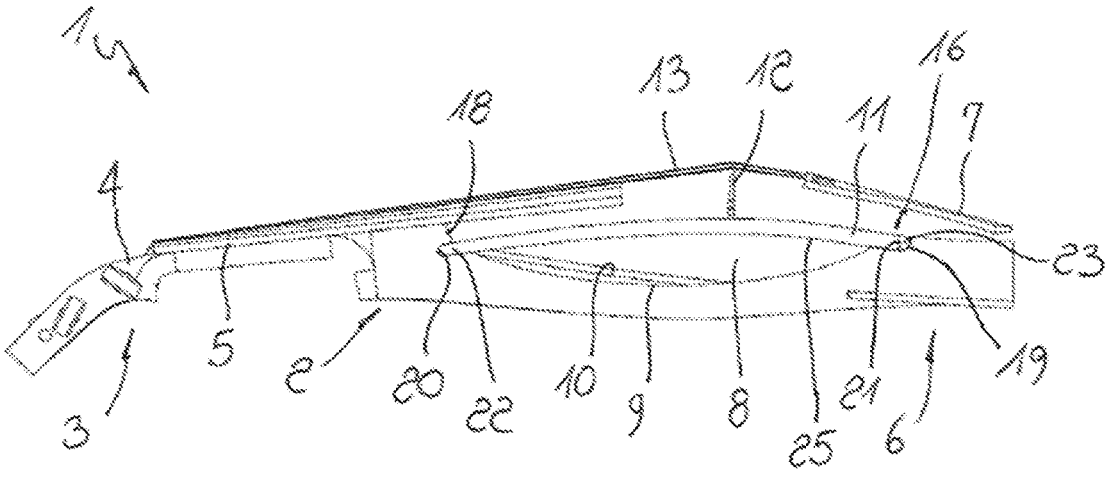
FIG. 3 is a side view of the structure of FIG. 1.

The bottom 9 will have a slightly concave upper surface 10 similar to what happens with traditional instruments, as shown in FIG. 3.

At the central recess 8 there is arranged a soundboard 11 transversely offset from the bottom 9 and associated with a bridge 12 which extends orthogonally thereto and therefore transversely with respect to the frame 2 to support the strings 13 which extend from the keyboard 5 to the tailpiece 7.

These last two elements may be designed according to any typical mode for the sector and therefore will not be further described.

Similarly, the bridge 12 may also have any configuration according to the preference of the luthier, even if the instrument structure will be appropriately designed to allow the use of a standard bridge, shaped by the luthier based on the preferences of the musician.

According to a particularly advantageous aspect, the bridge 12 will be positioned resting on the soundboard 11 to be held in position by the strings 13 which will press it against the soundboard 11.

In this way the bridge 12 may be displaced longitudinally and transversely to adjust, at will of the musician, the centering of the strings 13 on the keyboard 5 and the tuning fork, that is the length of the string in a vacuum vibration.

In a preferred manner, the structure 1 according to the invention will be designed for manufacturing an electric type instrument and for this purpose the frame 2 will also comprise means for the electrical connection to sound amplification means, not shown as of the type known per se and not limiting the present invention.

In particular, the electrical connection means will comprise a pick-up 14 or transducer, preferably of a piezoelectric nature, associated directly with the soundboard 11 and placed in a position dislocated with respect to the bridge 12 so as to directly intercept the vibrations of the soundboard 11 after the resonance effect between bridge 12, soundboard 11 and bottom 9, made possible thanks to the structure, has already been established.

It will be precisely this resonance that will make up a spectrum in which there will be an optimal balance between high and low components, without having to provide for filters of any kind, either mechanical or electronic.

Preferably, the pick-up 14 will be movable with respect to the soundboard 11 to allow the musician to choose the preferred position and vary the picked components of the sound and obtain different tonal results.

Advantageously, the frame 2 may comprise a seat 15 for housing the pick-up 14 at the rear longitudinal end 16 of the soundboard 11, below it, since it represents the best point for picking up the vibrations. Alternatively, the pick-up 14 may simply be placed on the frame 2.

The pick-up 14 is connected to a plug-in socket 17 of the amplification means made on a side of the frame 2. In particular, the plug-in socket 17 will be designed to be coupled to a common pin or jack for connection to an amplifier.

The connection between the pick-up 14 and the plug-in socket 17, not shown, may be made either by cables passing inside the frame 2 or by external cables.

According to a not shown variant, the connection between the pick-up 14 and the amplification means may be carried out wirelessly to avoid the use of connection cables and to improve the ease of use of the instrument. In this case it will be possible to use electronic filters in order to eliminate any disturbances but which will not affect the nature of the sound.

As can be seen more clearly from FIG. 3, the soundboard 11 is defined by an arcuated body having a convexity facing opposite to that of the bottom 9 and from which the bridge 12 extends along a substantially orthogonal direction, positioning itself along the bisector of the angle formed by the strings 13.

Conveniently, the arcuated body 11 will be defined by a sheet of wood or similar material suitable for being flexed to be inserted by interlocking or with slight play inside the recess 8.

In the construction phase the soundboard 11, after having been shaped in its curved shape, will be planed laterally so that it can be tuned since the quantity of wood that is removed contributes to determining its natural resonance frequency.

The recess 8 comprises a front face 18 and a rear face 19 which are reciprocally facing and longitudinally offset, each of which is provided with a respective groove 20, 21 for the insertion of respective front edge 22 and rear edge 23 of the soundboard 11, which can be inserted in a forced manner or with minimum play between the grooves 20, 21.

In the event that the soundboard 11 is inserted with play, albeit minimal, its position will be blocked due to the pressure exerted on it by the strings 13 brought into tension during tuning, which will thus block it pushing the two edges 22, 23 against the grooves 20, 21.

This particular embodiment of the soundboard 11, together with the method of connection with the bottom 9, will make it possible to have a soundboard 11 adapted to optimally resist to the pulling and squeezing action of the strings 13.

Figure 4:
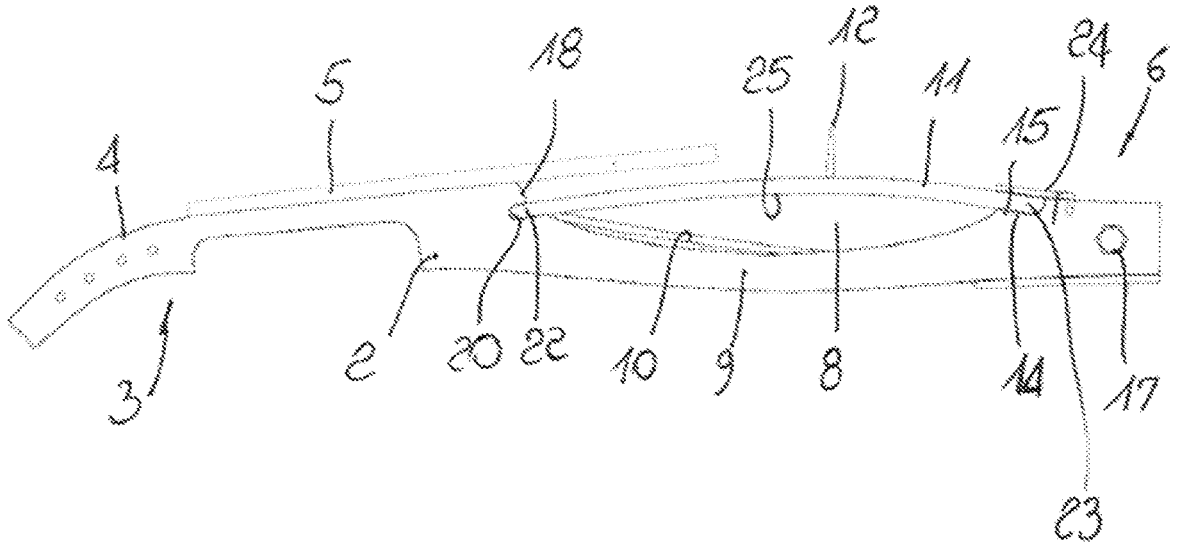
FIG. 4 is a side view of the structure of FIG. 1 in a particular variant.

Possibly, as shown in FIG. 4, for greater stability of the soundboard 11, the groove 21 formed in the rear face 19 may comprise a clip 24 or similar stop element removably anchored to the frame 2 so as to close upwardly the rear end 16 of the soundboard 11 and prevent it from rising during use.

Finally, the soundboard 11 and the bottom 9 of the frame 2 will have surfaces 25, 10 facing each other, both concave with opposite curvatures and having a substantially equal maximum width, so as to present an optimal ratio between the surface exposed to the re-entry sound waves and mass, also establishing a play of resonance between the two parts that approximates what happens in a traditional violin in a more efficient way than the known traditional instruments.

According to a particularly preferred variant, one or more rubber elements or other elastomeric material suitable for increasing the stability of the front end 22 of the soundboard 11 will be inserted inside the front groove 20, being also adapted to absorb the vibrations and further improving the global acoustic effect.

In this way the soundboard will be housed in an even more stable manner in order to prevent the formation of vibrations due to a possible oscillation motion.

Figure 5:
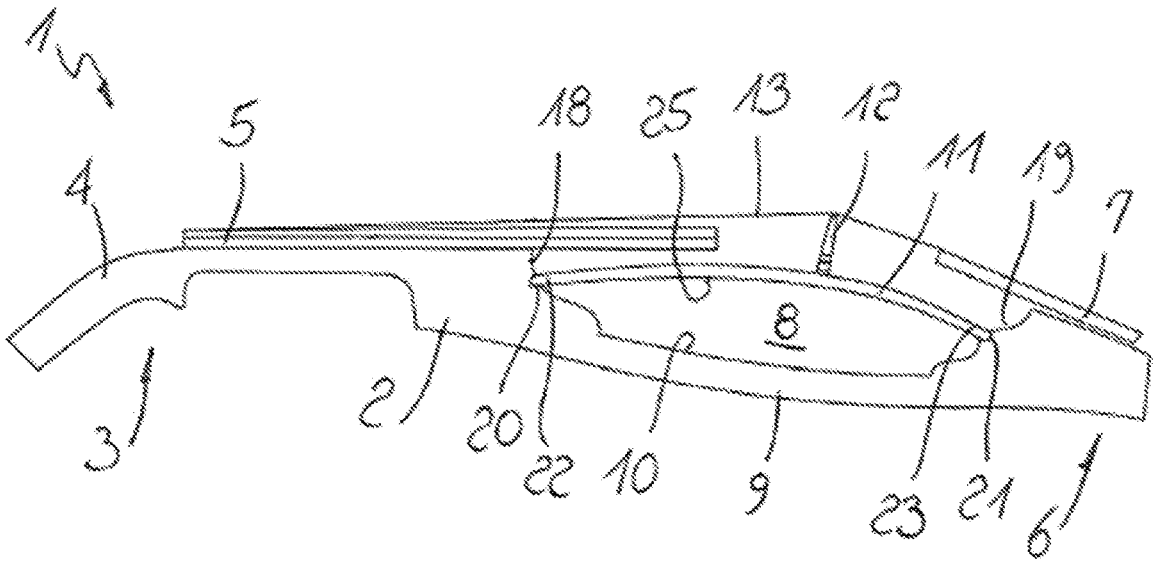
FIG. 5 is a perspective view of the structure in a second embodiment.

FIG. 5 shows a particular variant which differs from the preceding ones essentially in that both the grooves 20, 21 are designed for snugly fitting the edges 22, 23 of the soundboard 11 which will be preferably interlocked in the recess 8.

In all the illustrated embodiments, the arcuated shape of the soundboard 11 and the aforementioned position constraints imposed on its end edges 22, 23 will allow the perfect counterbalance to the crushing action produced by the strings 13 and will make it unnecessary to use props or other lower supports, which on the contrary would be counterproductive since they would inhibit the natural vibration motion of both the soundboard 11 and the bottom 9 which, precisely in that position, find the maximum of oscillations.

The frame 2 may be completed by one or more appendixes, such as a backrest 26 fixed in a stable or removable manner, a chin-guard, not shown, or other types of structures configured according to the needs of the musician, without particular limitations in the scope of protection. of the present invention.

Figure 6:
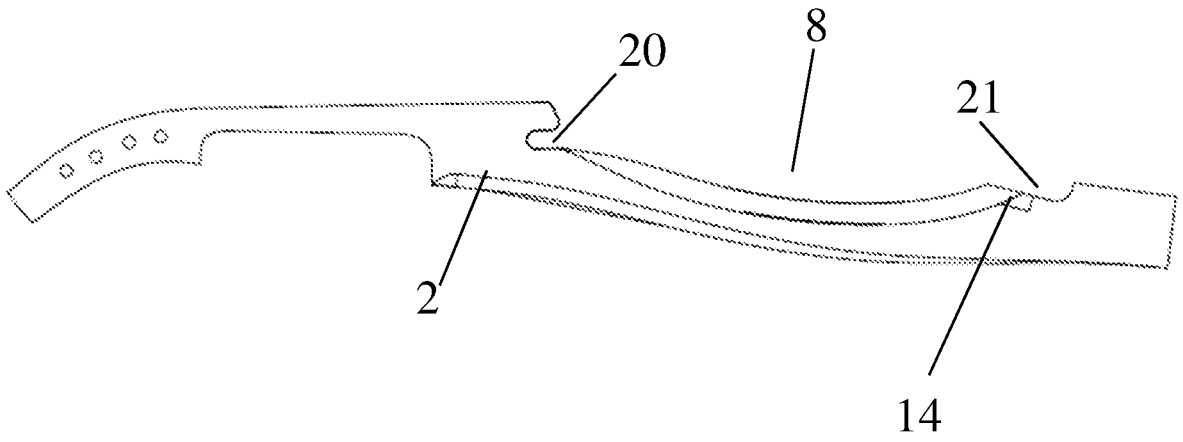
FIG. 6 is a side view of the structure in a third embodiment.

FIG. 6 shows a third embodiment which differs from the previous ones essentially in the fact that both the front groove 20 and the rear groove 21 have a longer length to increase the contact surface between frame 2 and soundboard 11.

Moreover, the pick-up 14 is arranged towards the front edge of the same groove 21 in a more advanced position with respect to the previous embodiment. Moreover, the pick-up 14 also has an increased thickness, as well as the frame 2 and the soundboard 11.

According to a not shown variant, an element adapted to facilitate the locking of the soundboard 11 within the recess 8 may be arranged at the pick-up 14. For example, a screw adjustment system may be provided which will allow the clamping of the soundboard 11 after its insertion into the recess 8.

From above it is evident that the instrument structure according to the invention achieves the intended objects.

The instrument structure according to the invention is susceptible of numerous modifications and variations, all of which are within the inventive concept expressed in the appended claims. All the details may be replaced by other technically equivalent elements, and the materials may be different according to requirements, without departing from the scope of protection of the present invention.

Although the instrument structure has been disclosed with particular reference to the attached figures, the reference numbers used in the description and in the claims are used to improve the intelligence of the invention and do not constitute any limitation to the claimed scope of protection.

The invention claimed is:

1. An electric bowed string instrument structure, comprising:

a longitudinally elongated frame (2) having a front end portion (3) provided with a neck (4) and a rear end portion (6), said frame (2) having a central recess (8) provided with a bottom (9);

a fingerboard (5) anchored to said neck (4);

a tailpiece (7) anchored to said rear end portion (6) of said frame (2);

a plurality of strings (13) extending between said fingerboard (5) and said tailpiece (7);

a bridge (12) which extends transversely with respect to said frame (2) and is adapted to support said strings (13);

a pick-up (14) adapted to intercept the vibrations produced by said strings (13) and to be connected to sound amplifying means;

wherein said frame (2) comprises a soundboard (11) inserted between said fingerboard (5) and said tailpiece (7);

characterized in that said soundboard (11) interlocked in said recess (8) in a transversely offset position with respect to said bottom (9), said soundboard (11) being convex with a convexity facing towards said strings (11), said pick-up (14) being arranged below said soundboard (11).

2. Instrument structure as claimed in claim 1, characterized in that said recess (8) comprises a front face (18) and a rear face (19) facing each other and provided with respective grooves (20, 21) for snugly fitting respective front (22) and rear (23) longitudinal edges of said soundboard (11).

3. Instrument structure as claimed in claim 2, characterized in that at least one of said grooves (20, 21) houses one or more elastomeric elements adapted to define a thickness for the interlocking insertion of the respective of said longitudinal edges (22, 23) of said soundboard (11).

4. Instrument structure as claimed in claim 1, characterized in that said bridge (12) rests on said soundboard (11) to transfer to it the pressure generated by said strings (13) during tuning.

5. Instrument structure as claimed in claim 4, characterized in that said soundboard (11) is formed with a sheet of wood or a similar flexible material.

6. Instrument structure as claimed in claim 5, characterized in that the groove (21) made in said rear face (19) of said recess (8) comprises a stop element (24) removably anchored to said frame (2) and suitable to prevent the raising of the rear edge (23) of said soundboard (11).

7. Instrument structure as claimed in claim 1, characterized in that said bridge (12) is movable on said soundboard (11) to allow adjustment of its longitudinal and/or transverse position.

8. Instrument structure as claimed in claim 1, characterized in that said pick-up (14) is of the piezoelectric type and is displaceable with respect to said soundboard (11).

9. Instrument structure as claimed in claim 8, characterized in that said frame (2) comprises a seat (15) for housing said pick-up (14) at said rear edge (23) of said soundboard (11), beneath thereto.

10. Instrument structure as claimed in claim 9, characterized in that said soundboard (11) and said bottom (9) of said frame (2) have respective concave surfaces (25, 10) reciprocally facing and having opposite concavities.

11. Instrument structure as claimed in claim 10, characterized in that said reciprocally facing concave surfaces (25, 10) have a maximum width substantially equal to each other.

* * * * *